United States Patent [19]

Kuo

[11] 4,314,575

[45] Feb. 9, 1982

[54] MULTI-PURPOSE STICKS OR CANES

[76] Inventor: Chin-Tui Kuo, No. 1-10, Ta Ho I Hsiang, Hsi Tun District, Taichung, Taiwan

[21] Appl. No.: 124,966

[22] Filed: Feb. 27, 1980

[51] Int. Cl.[3] ..... A45B 3/00; A45B 3/14

[52] U.S. Cl. ..... 135/66; 273/68

[58] Field of Search ..... 135/66, 65; 16/108; 273/68-72, 67 R

[56] References Cited

U.S. PATENT DOCUMENTS

| | | | |
|---|---|---|---|
| 281,245 | 7/1883 | Degenhart | 135/65 |
| 298,111 | 5/1884 | Morse | 135/66 X |
| 880,047 | 2/1908 | Smith | 135/66 |
| 1,765,076 | 6/1930 | Jung | 135/66 |
| 2,923,063 | 2/1960 | Hansen | 135/66 X |

FOREIGN PATENT DOCUMENTS

| | | | |
|---|---|---|---|
| 59469 | 10/1891 | Fed. Rep. of Germany | 135/66 |
| 154541 | 8/1932 | Switzerland | 135/66 |

*Primary Examiner*—J. Karl Bell

*Attorney, Agent, or Firm*—Holman & Stern

[57] ABSTRACT

A multi-purpose stick or cane is comprised of a hollow main body with its one end being closed and its other end being opened, a copper head member adapted to come in threaded engagement with the fore end of the body, a rod member adapted to be accommodated in the hollow portion of the body, and a head member adapted to come in threaded engagement with the rear end of the rod member and to be threadedly fixed on a joint of the rear end of the body. This stick or cane is used as a walking stick, a birch rod, a cue, an alpenstock or the like.

3 Claims, 9 Drawing Figures

MULTI-PURPOSE STICKS OR CANES

FIELD OF THE INVENTION

The present invention relates to a multi-purpose stick or cane which may be used as a walking stick, an indicator such as a birch rod, a cue, an alpenstock or the like by various combinations of dexterously designed parts, said combinations being readily achieved.

SUMMARY OF THE INVENTION

A main object of the present invention is to provide a novel multi-purpose stick or cane essentially comprising a hollow main body with its one end being closed and its other end being opened, said body being threadedly provided at its both ends with copper jackets and having a hollow portion; a copper head member adapted to removably come in threaded contact with the copper jacket provided at the fore end of said body and having a spherical head at its fore end; a rod member adapted to be accommodated in said hollow portion and having a resilient cue tip at its fore end and a copper joint fixed at its rear end; and a head member adapted to removably come in threaded contact with the rear end of said rod member and to removably come in threaded engagement with the copper jacket provided at the rear end of said body by means of a copper joint having an externally threaded portion divided into two sections; said multi-purpose stick or cane being used as a walking stick in a normally assembled state; a birch rod or indicator in a state where said head member is removed together with said rod member from said body; a cue in a state where said copper head member and said head member are removed from said body and said rod member, respectively, to permit said rod member to come in threaded contact with the fore end of said body and, thereupon, said spherical head is fitted to said head member to permit said head member to come in threaded engagement with the rear end of said body; or the like means.

Other objects and advantages of the present invention will be apparent from the following detailed description.

DETAILED DESCRIPTION OF THE INVENTION

The present invention will now be explained in detail with reference to the accompanying drawings wherein.

Figure 1:
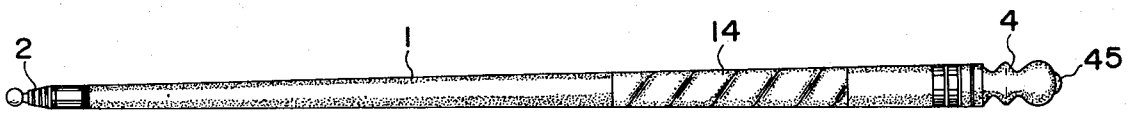
FIG. 1 is a front view of a walking stick according to the present invention.
Figure 2:
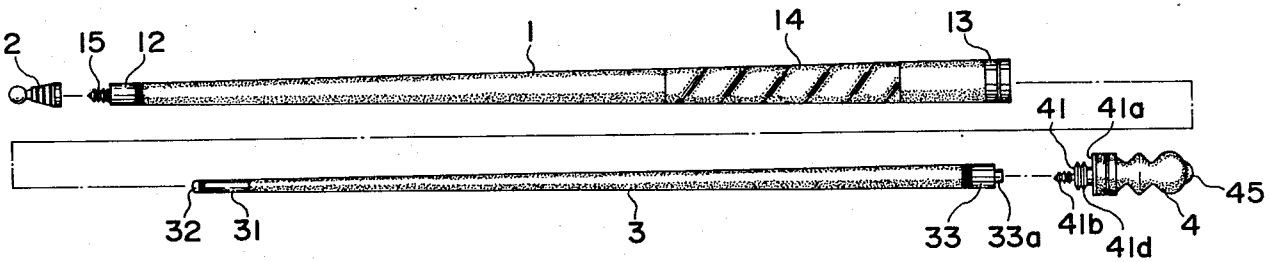
FIG. 2 is an exploded view of the multi-purpose stick or cane according to the present invention.

As illustrated in FIGS. 1 and 2, the stick or cane of the present invention is essentially constructed from a total of four members, i.e., a hollow main body 1 with its one end being closed and its other end being opened, a copper head member 2 adapted to come in threaded engagement with the fore end (the left-hand end in the drawings) of body 1, a rod member 3 adapted to be accommodated in the hollow portion of body 1, and a head member 4 adapted to come in threaded engagement with the rear end (the right-hand end in the drawings) of rod member 3 and to be threadedly fixed on a joint of the rear end of body 1.

Figure 3:
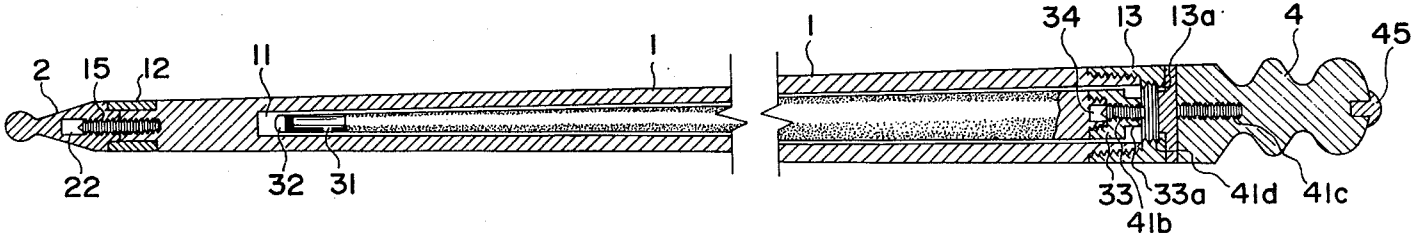
FIG. 3 is a partially enlarged sectional view of FIG. 1, showing the construction of the junction.

As shown in FIG. 3, the aforesaid body 1 may be a hollow rod section formed of a wood or aluminium alloy material with its one end being made thick and its other end being made thin, which section is constructed such that its hollow portion 11 receives rod member 3. A copper jacket 12 is screwed over the fore end of body 1. The fore end of hollow body 1 is further provided at its center with a threaded portion 15 which extends outside of copper jacket 12. A copper jacket 13 is similarly screwed over the rear end of body 1, and is provided on its outside with an internally threaded portion 13*a* adapted to come in threaded engagement with head member 4. The conically shaped copper head member 2 has a spherical head 21 at its fore end, and is axially provided in its other end with a threaded bore 22. Thus, the body 1 is integrally connected with head member 2 by screwing the threaded portion 15 into bore 22.

The rod member 3 is fitted at its fore end with a plastic tube 31, which tube is closely fixed at its fore end with a resilient cue tip 32. A copper joint 33 screwed into the rear end of rod member 3 has an outer diameter equal to that of copper jacket 13, and is formed at its free end with a reduced portion 13*a* which is adapted to fit exactly into the bore in copper jacket 13. The copper joint 33 is also provided on its inside with an internally threaded portion 33*b* in communication with a threaded bore 34 in rod member 3. The head member 4 is formed of a wood or aluminium alloy material, and is designed to provide a grip of a suitable form. A copper joint 41 which has a flange 41*a* and threaded portions 41*b* and *c* extending from its both sides is screwed into one end of head member 4. Further, there is provided between flange 41*a* and one threaded portion 41*c* an externally threaded portion 41*d* which is adapted to come in threaded engagement with one section of the internally threaded portion 13 of copper jacket 13 fitted to body 1. The head member 4 is integrally connected with rod member 3 by screwing threaded portion 41*c* into bore 33*b* provided in joint 33 of rod member 3. Accommodation of rod member 3 in the interior of hollow body 1 is then achieved by screwing threaded portion 41*d* into copper jacket 13 fitted to the rear end of hollow body 1, so that a walking stick is formed as shown in FIGS. 1 and 3. The head member 4 is provided in its other end with a U-shaped bore into which a rubber band 45 is threadedly inserted. It should here be noted that reference numeral 14 denotes a leather band adapted to cover the rear portion of body 1 for decoration thereof. Such a leather band 14 may be formed to take various shapes according to need. When the rear portion is not covered with such a decoration band, said portion may be painted.

Figure 4:
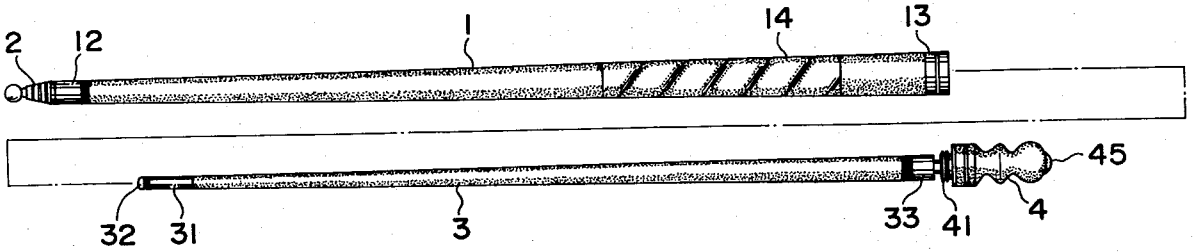
FIG. 4 is a front view of a walking stick in which the rod member has been removed together with the head member from the hollow body.
Figure 5:
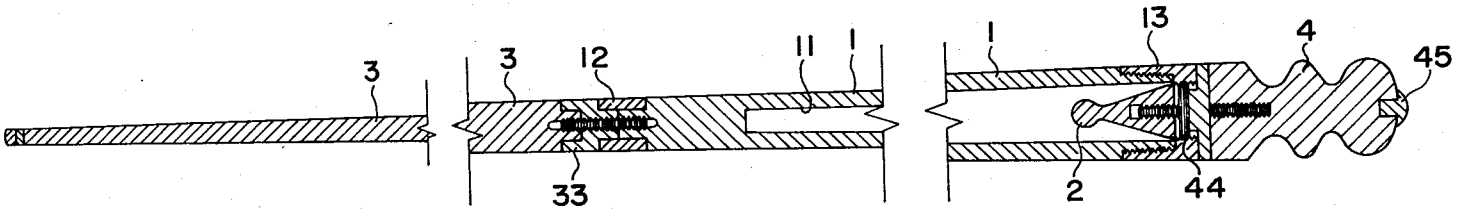
FIG. 5 is a partially cut away front view of a cue according to the present invention.

The stick or cane of the present invention provides a walking stick as shown in FIG. 1 in a normally assembled state. When the head member 4 is screwed out of body 1 together with rod member 3, they form together a birch rod or an indicator as shown in FIG. 4. Such a birch rod may be used when illustrating words or figures put down on a blackboard or a wall chart. The hollow body 1 is then used as a cover or case for protection of rod member 3. As illustrated in FIG. 5, the stick or cane of the present invention may be employed as a cue in a billiard room. In this case, the head member 4 and the copper head member 2 are removed from rod member 3 and hollow body 1, respectively, and the copper head member 2 is permitted to come in threaded contact with the fore end of head member 4. Thereafter, the head member 4 is threadedly inserted into copper jacket 13 of body 1 with the copper head member 2 being put toward hollow portion 11. The end of joint 33 of rod member 3 is then brought into threaded contact with copper jacket 12 of body 1. Further, it is possible to adjust the weight of the cue by removing copper head member 2 therefrom. Such adjustment may be carried out according to the user's preference.

Figure 6:
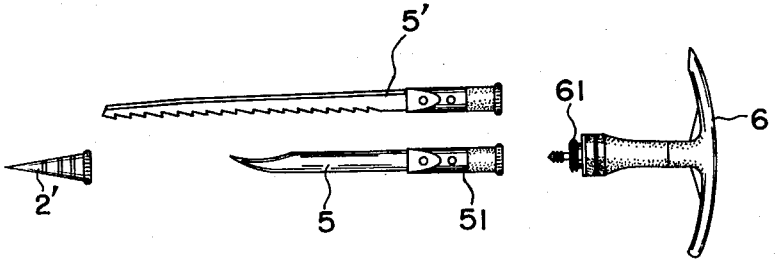
FIG. 6 is an exploded view of mountaineering equipment according to the present invention.
Figure 7:
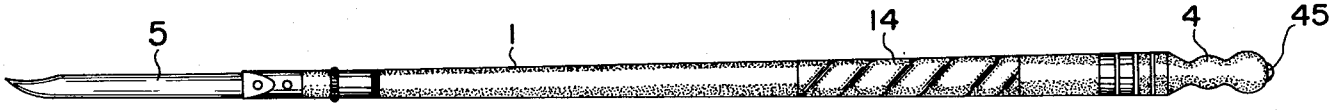
FIG. 7 is a front view of a stick provided with a knife.
Figure 8:
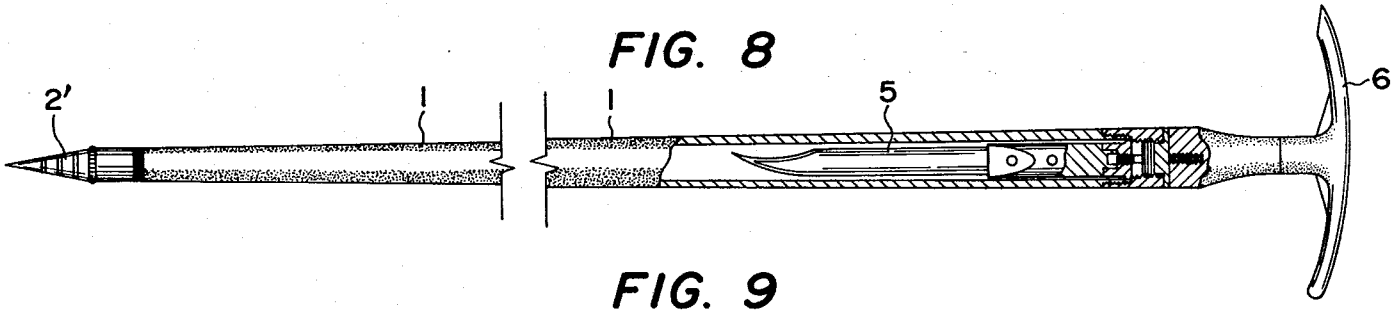
FIG. 8 is a partially cut away front view of an alpenstock according to the present invention.

In order to permit wide exploitation of the stick or cane of the present invention, there is also provided mountaineering equipment as shown in FIG. 6. Such equipment comprises two parts, i.e., a mountaineering knife part 5 or saw part 5' and a pick part 6. The handle of part 5 or 5' is threadedly connected to the end of a joint 61. It should be noted that the construction of joint 61 is not shown or illustrated since it is identical with that of joint 41. The rod member 3 and the head member 4 are removed from hollow body 1, and the part 5 or 5' is fitted together with part 6 to copper jacket 13 of body 1, so that an alpenstock is formed as shown in FIG. 8. During use, the knife or saw part is normally accommodated in hollow body 1, but it is readily removed from part 6 according to need, as shown in FIG. 8.

Figure 9:
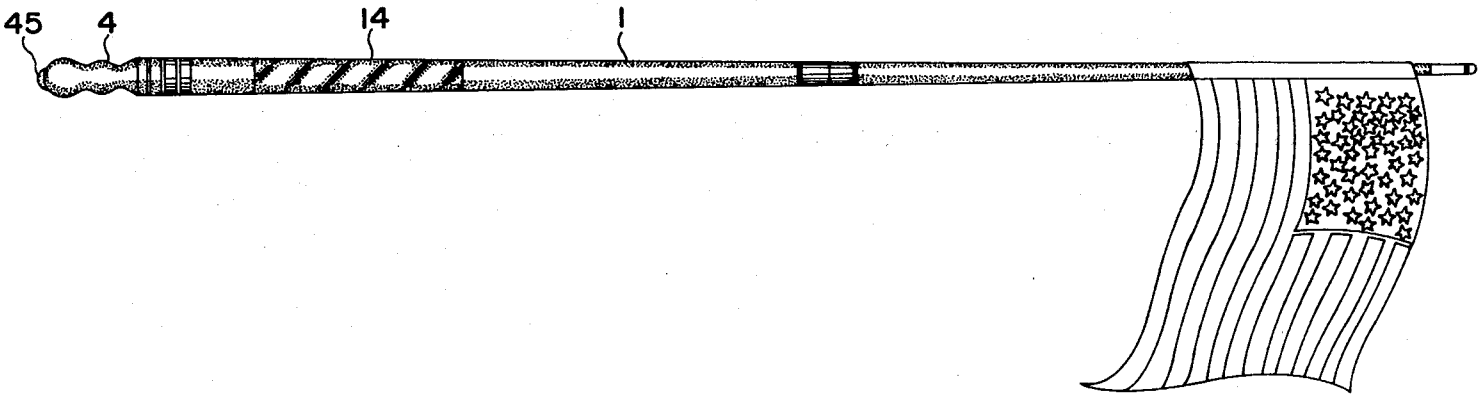
FIG. 9 is a front view of a flagpole according to the present invention.

As shown in FIG. 9, the stick or cane according to the present invention may be used as a flagpole.

As explained above, the stick or cane of the present invention finds use in various forms including a walking stick, an indicator such as a birch rod, an alpenstock or the like by various combinations of dexterously designed parts of members. Further, such combinations are very easily achieved. Thus, in accordance with the present invention, there is provided a novel and attractive multi-purpose stick or cane.

While the invention has been described in detail and with reference to specific embodiments thereof, it will be apparent to one skilled in the art that various changes and modifications can be made therein without departing from the spirit and scope thereof.

What is claimed is:

1. A multi-purpose cane comprising an elongated hollow tubular outer body having a continuously tapering configuration along its length, a hollow tubular metallic sleeve member fixedly attached to the smaller end of said outer body having an outer diameter the same as that of said smaller end so that its outer surface is continuous with that of said body and extending beyond said smaller end to provide a recess therein, an externally threaded extension extending coaxially from said smaller end beyond said sleeve, a metallic ground contacting member having a tapering cylindrical configuration the larger end of which has an outer diameter equal to that of said sleeve, said ground contacting member having a coaxial threaded bore to threadedly engage said threaded extension and a reduced extension on its larger end to interfit in close fitting relationship within said recess, the larger end of said outer body being reduced in diameter to form a shoulder, an external thread on said reduced portion, a metallic hollow tubular connector sleeve having a first internal threaded portion engaging said external thread on said reduced end of said body and a second internal threaded portion having a smaller diameter than and axially displaced from said first threaded portion, the outer diameter of said connector sleeve being equal to that of said larger end of said outer body so that it forms a continuous tapered cylindrical surface therewith, a hand grip member having a connecting end portion of cylindrical shape with an outer diameter substantially equal to that of said connector sleeve to form a continuous tapered surface therewith, a first reduced diameter externally threaded extension on said connecting end for threaded engagement with said second internal threaded portion of said connector sleeve, a second reduced diameter externally threaded extension on said connecting end of the same size as said threaded bore in said ground contacting member, an elongated cylindrical continuously tapering coaxial bore within said outer body, the larger diameter of which is at the same end as that of said outer body, an elongated cylindrical continuously tapering inner body removably insertable within said bore in said outer body, the largest diameter of said inner body being slightly smaller than said second internal threaded portion of said connector sleeve, a metallic connector sleeve on the larger end of and threadedly connected to said inner body having an outer cylindrical tapering surface the larger diameter of which equals the smaller diameter of said sleeve member on the smaller end of said outer body, a reduced coaxial extension on said connector sleeve of said inner body having the same shape and size as said reduced extension on said ground contacting member, and a coaxial threaded bore in said connector sleeve of said inner body having the same size as said bore in said ground contacting member, so that said ground contacting member and said inner body may be interchangeably attached by said threaded extensions to said smaller end of said outer body or to said hand grip member when stored in said elongated bore.

2. A multipurpose cane as recited in claim 1 wherein the smaller end of said inner body has a billiard cue tip mounted thereon.

3. A multipurpose cane as recited in claim 1 wherein said inner body is a knife blade and said hand grip is a mountaineer's pick tool.

* * * * *